US011537155B2

(12) United States Patent
Fiocchi et al.

(10) Patent No.: US 11,537,155 B2
(45) Date of Patent: Dec. 27, 2022

(54) LOW-DROPOUT REGULATOR HAVING REDUCED REGULATED OUTPUT VOLTAGE SPIKES

(71) Applicant: ams AG, Premstaetten (AT)

(72) Inventors: Carlo Fiocchi, Belgioioso (IT); Valerio Pisati, Bosnasco (IT)

(73) Assignee: ams AG, Premstaetten (AT)

( * ) Notice: Subject to any disclaimer, the term of this patent is extended or adjusted under 35 U.S.C. 154(b) by 735 days.

(21) Appl. No.: 16/493,039

(22) PCT Filed: Mar. 12, 2018

(86) PCT No.: PCT/EP2018/056067
§ 371 (c)(1),
(2) Date: Sep. 11, 2019

(87) PCT Pub. No.: WO2018/172122
PCT Pub. Date: Sep. 27, 2018

(65) Prior Publication Data

US 2020/0012302 A1 Jan. 9, 2020

(30) Foreign Application Priority Data

Mar. 23, 2017 (EP) ..... 17162558

(51) Int. Cl.
*G05F 1/575* (2006.01)
*G05F 3/26* (2006.01)
*G05F 1/56* (2006.01)

(52) U.S. Cl.
CPC ..... *G05F 1/575* (2013.01); *G05F 3/26* (2013.01); *G05F 1/56* (2013.01)

(58) Field of Classification Search
CPC ..... G05F 1/575
See application file for complete search history.

(56) References Cited

U.S. PATENT DOCUMENTS 6,300,749 B1 * 10/2001 Castelli ..... G05F 1/575 323/276
6,518,737 B1 * 2/2003 Stanescu ..... G05F 1/575 323/280

(Continued)

FOREIGN PATENT DOCUMENTS

CN 202033682 11/2011
CN 102385410 3/2012

(Continued)

OTHER PUBLICATIONS

China National Intellectual Property Administration Search Report issued in Chinese Application No. 201880020348.3, dated Apr. 20, 2020, 3 pages (English translation).

(Continued)

*Primary Examiner* — Yusef A Ahmed
(74) *Attorney, Agent, or Firm* — MH2 Technology Law Group LLP

(57) ABSTRACT

A low-dropout regulator having an output current branch being arranged between a supply line to provide a supply potential and an output node to provide a regulated output voltage. The output current branch includes an output driver to provide an output current at the output node. The output driver has a control connection to apply a control voltage to operate the output driver with a different conductivity in dependence on the control voltage. The LDO includes an input amplifier stage to provide the control voltage to the control connection of the output driver. The input amplifier stage is configured to provide the control voltage with a different slew rate in dependence on an increase or decrease of the output current.

7 Claims, 3 Drawing Sheets

(56) References Cited

U.S. PATENT DOCUMENTS 6,710,583 B2 * 3/2004 Stanescu ..... G05F 1/575 323/280
7,135,912 B2 * 11/2006 Perez ..... H03F 1/56 327/543
7,248,025 B2 * 7/2007 Adachi ..... G05F 1/575 323/280
7,612,547 B2 * 11/2009 Renous ..... G05F 1/575 323/280
7,746,047 B2 * 6/2010 Yin ..... G05F 1/575 323/273
7,768,351 B2 * 8/2010 Ivanov ..... H03F 3/45183 330/255
7,982,448 B1 * 7/2011 Prasad ..... G05F 1/575 323/311
8,242,761 B2 * 8/2012 Napravnik ..... G05F 1/575 323/280
8,674,672 B1 * 3/2014 Johal ..... G05F 1/575 323/280
2002/0130646 A1 * 9/2002 Zadeh ..... G05F 1/575 323/275
2003/0102851 A1 * 6/2003 Stanescu ..... G05F 1/575 323/280
2003/0178976 A1 * 9/2003 Xi ..... G05F 1/575 323/273
2006/0197513 A1 * 9/2006 Tang ..... G05F 1/575 323/273
2007/0216382 A1 * 9/2007 Lin ..... G05F 1/575 323/273
2008/0224680 A1 * 9/2008 Suzuki ..... G05F 1/56 323/284
2009/0251219 A1 * 10/2009 Fiocchi ..... H03F 3/45183 330/291
2009/0273323 A1 * 11/2009 Kimura ..... G05F 1/56 323/265
2010/0109624 A1 * 5/2010 Lourens ..... G05F 1/575 323/280
2010/0164451 A1 * 7/2010 Cerchi ..... G05F 1/565 323/282
2011/0025280 A1 * 2/2011 Kimura ..... H03F 3/45475 330/252
2012/0169422 A1 * 7/2012 Fiocchi ..... H03G 1/0035 330/257
2013/0285631 A1 * 10/2013 Bisson ..... G05F 1/575 323/280
2013/0293986 A1 * 11/2013 Lerner ..... G05F 1/573 361/18
2014/0117958 A1 * 5/2014 Price ..... G05F 1/468 323/281
2014/0375289 A1 * 12/2014 Kronmueller ..... G05F 1/565 323/280
2015/0123635 A1 * 5/2015 Huang ..... G05F 1/575 323/281
2015/0185747 A1 * 7/2015 Liu ..... G05F 3/30 323/268
2015/0205319 A1 * 7/2015 De Cremoux ..... G05F 3/262 331/109
2016/0252924 A1 * 9/2016 Masoumi ..... G05F 3/262 323/313
2019/0113942 A1 * 4/2019 Murukumpet ..... G05F 1/575
2019/0258282 A1 * 8/2019 Magod Ramakrishna ..... G05F 1/575
2019/0258283 A1 * 8/2019 Pishdad ..... G05F 1/575
2020/0050225 A1 * 2/2020 Fiocchi ..... G05F 1/575
2020/0310478 A1 * 10/2020 Azevedo ..... H03F 3/45183
2022/0253083 A1 * 8/2022 Grande ..... G11C 16/30

FOREIGN PATENT DOCUMENTS

CN 102609025 A 7/2012
CN 103399608 11/2013
CN 103412602 A 11/2013
CN 103472880 12/2013
CN 104950976 A 9/2015
CN 105242734 A 1/2016
EP 2894538 A 7/2015

OTHER PUBLICATIONS

European Patent Office, International Search Report for PCT/EP2018/056067, dated May 16, 2018.
Notification on Grant of Patent Right for Invention for Chinese Application No. 201880020348.3 dated Jan. 8, 2021, 6 pages.

* cited by examiner

LOW-DROPOUT REGULATOR HAVING REDUCED REGULATED OUTPUT VOLTAGE SPIKES

TECHNICAL FIELD

The disclosure relates to a low-dropout regulator having regulated output voltage spikes, particularly when an output current of the low-dropout regulator is increased.

BACKGROUND

A low-dropout regulator (LDO) is a DC linear voltage regulator that can regulate the output voltage even when the supply voltage is very close to the output voltage. The LDO provides a regulated output voltage at an output node that may be used to supply a load. An LDO usually comprises an output current branch arranged between a supply potential provided from a supply line and an output node of the LDO to provide the regulated output voltage. The supply line is coupled to a supply source to provide the supply potential at the supply line.

In some applications, it is required that the LDO does not provide a very large change in the output current that the LDO takes from the supply source to be delivered to the load. In an application where the LDO is supplied by means of a long cable, or when a large coil is present on the supply line, it is very important to minimize the supply current derivative. Especially, in the presence of a very small supply cap, the derivate of the output current is responsible for large voltage spikes at the coil terminal of the supply cap.

The output current branch comprises an output driver to provide an output current at the output node, when a load is connected to the output node. The output driver may be configured as a power transistor having a control connection, for example a gate connection, to apply a control voltage for controlling the conductivity of the power transistor. In order to minimize a derivative of the supply current, the control connection/gate connection of the power transistor may be charged/discharged under a slew rate limitation of the control voltage. Hence, the current supply derivative is limited and, in the case of a large coil on the supply line, the supply line is less disturbed.

The slew rate limitation of the control voltage by which the control connection of the output driver is charged/discharged is especially reasonable in the case of large output currents. On the other hand, in the case of a small output current the derivative of the supply current is very small and no significant disturbance on the supply line is observed. Contemporarily, the output driver is not very sensitive at gate regulation for light load currents. As a consequence, large spikes affect the regulated voltage at the output node after a huge transient of the output current towards higher values.

A faster response of the output driver would reduce the spikes at the regulated output voltage but emphasize the supply current variations. Optimization is not possible as the supply stress depends on the power device biasing point.

This is because the power device transconductance is bigger at larger output currents.

It is desired to provide a low-dropout regulator having reduced regulated output voltage spikes, when the output current of the LDO changes.

SUMMARY

A low-dropout regulator having reduced regulated output voltage spikes, if a change of the output current occurs, is specified in claim 1.

The low-dropout regulator comprises an output node to provide a regulated output voltage and an output current branch being arranged between a supply line to provide a supply potential and the output node. The output current branch comprises an output driver to provide an output current at the output node. The output driver has a control connection to apply a control voltage. The output driver is configured to be operated with a different conductivity in dependence on the control voltage. The low-dropout regulator further comprises an input amplifier stage to provide the control voltage to the control connection of the output driver. The input amplifier stage is configured to provide the control voltage with a different slew rate in dependence on an increase or decrease of the output current.

In the presence of an output current/load current transient at the output node of the LDO, the largest current spikes at the supply line are generated when the output/load current tends to decrease instead of increasing, independently from the implementation of the LDO. On the contrary, the spikes of the regulated output voltage at the output node are fairly dependent on the LDO architecture but are generally much larger when the output/load current increases its value. The reason for this is the transconductance of the output driver, for example the power transistor, which increases with the output/load current.

In this way, given the same ramp at the control connection of the output driver, for example a gate connection of a transistor, the achieved current variation at the supply line is larger when the output/load current is bigger, while it becomes nearly negligible when the output/load current is in the lowest range and the response of the LDO, for example the transistor arranged in the output current path, is too slow with consequently large spikes at the regulated output voltage.

The presented LDO is configured to increase the slew rate of the control voltage, for example the slew rate of a gate voltage ramp applied to a gate terminal of the transistor of the output driver, when the output/load current is small. In terms of supply-induced disturbances this is not detrimental because the associated supply current derivative remains small enough, but it helps remarkably to reduce the spikes at the regulated voltage at the output node of the LDO, as this is the right condition for them to occur.

DETAILED DESCRIPTION

Figure 1:
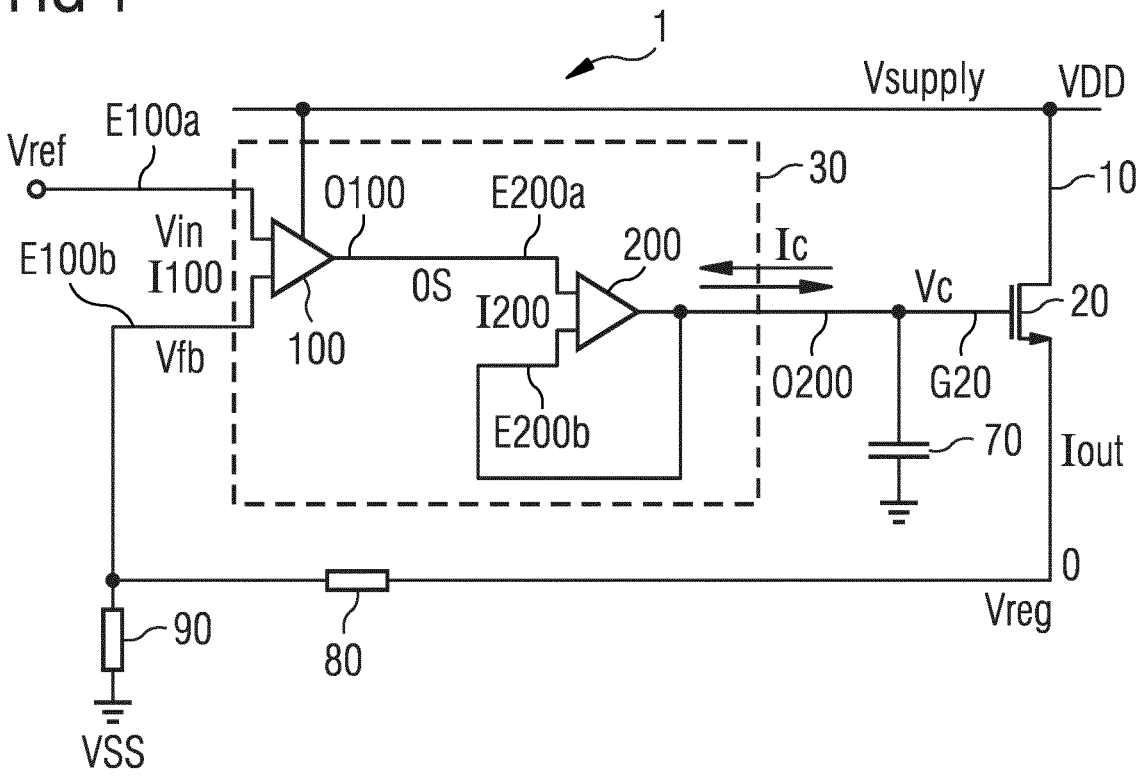
FIG. 1 shows a first embodiment of an LDO comprising a slew rate limited buffer circuit driving a control connection of an output driver.

FIG. 1 shows an open loop approach of an LDO 1 to limit the slew rate of a control voltage Vc, for example the gate voltage, of an output driver 20. The LDO comprises an output current branch 10 being arranged between a supply line Vsupply to provide a supply potential VDD and an output node O. The output current branch 10 comprises the output current driver 20 to provide an output current Iout at the output node O. The output driver 20 may be configured as a transistor, for example a power transistor. The output driver 20 has a control connection G20 to apply the control voltage Vc. The output driver 20 is configured to be operated with a different conductivity in dependence on the control voltage Vc. The application of the control voltage Vc to the control connection G20 of the output driver 20 is controlled by an input amplifier stage 30. The LDO 1 further comprises a capacitor 70. The capacitor 70 is arranged between a reference potential and the control connection G20 of the output driver 20.

According to a first embodiment of the input amplifier stage, the input amplifier stage 30 may comprise a single amplifier circuit 100 having an output side O100 that is directly connected to the control connection G20 of the output driver 20. In this case the amplifier circuit 100 controls the application of the control signal Vc for changing the conductivity of the output driver 20. The input amplifier stage 30 and, in particular, the input amplifier circuit 100 is supplied by the supply potential VDD that is delivered by the supply line Vsupply. The input amplifier circuit 100 has an input side I100 to apply a differential input signal Vin. The input amplifier circuit 100 has an input connection E100*a* to apply a reference signal Vref and an input connection E100*b* to apply a feedback signal Vfb. The input signal Vfb is derived from the regulated output voltage Vreg by a feedback net comprising a voltage divider. The voltage divider comprises the resistors 80 and 90.

According to a second embodiment of the input amplifier stage shown in FIG. 1, the input amplifier stage 30 comprises the input amplifier circuit 100 and additionally a buffer circuit 200. The buffer circuit 200 is connected between the output side O100 of the amplifier circuit 100 and the control connection G20 of the output driver 20. The input amplifier circuit 100 has the input connection E100*a* to apply the reference signal Vref and the input connection E100*b* to apply the feedback signal Vfb as described above.

The buffer circuit 200 has an input side I200 that is connected to the output side O100 of the input amplifier circuit 100. The input amplifier circuit 100 provides the output signal OS that is applied to the input side I200 of the buffer circuit 200. The input amplifier stage 30 is configured such that the buffer circuit 200 controls the application of the control signal Vc to control the output driver 20 by generating a control current Ic at an output side O200. The output side O200 of the buffer circuit 200 is connected to the control connection G20 of the output driver 20. As shown in FIG. 1, the buffer circuit 200 has an input connection E200*a* that is connected to the output side O100 of the input amplifier circuit 100 to receive the output signal OS of the input amplifier circuit 100 and an input connection E200*b*. The output side O200 of the buffer circuit 200 is fed back to the input connection E200*b*.

The input amplifier stage 30 is configured such that the control connection G20 of the output driver 20, for example the gate connection of the power transistor, is charged/discharged under a slew rate limitation. The input amplifier circuit 100 and/or the buffer circuit 200 provides the charge/discharge control current Ic such that the slew rate of the control voltage Vc at the control connection G20 of the output driver 20 is limited. That means that the input amplifier circuit 100 and/or buffer circuit 200 prevents the control voltage Vc, for example a gate-source voltage of the transistor 20, from increasing too fast so that the output current Iout also cannot vary too fast. As a consequence, a moderately safe control over the supply current variation is achieved. Hence, the current supply derivative is limited and, in case of a large coil connected to the supply potential VDD, the supply line Vsupply is less disturbed.

Despite being less precise, being dependent on temperature, operating conditions and process, the main advantage of the open loop approach of the LDO shown in FIG. 1 is the absence of any regulation lag. For the sake of simplicity, the output driver is shown in FIG. 1 as an N-MOS power transistor. However, the same considerations hold for a P-MOS approach.

As explained above, the buffer circuit 200 can be eliminated so that the input amplifier stage 30 only comprises the input amplifier circuit 100 that directly drives the capacitor 70 and the control connection G20 of the output driver 20 with similar slew rate limitations of the control voltage Vc. The advantage offered by splitting the input amplifier stage 30 so that the input amplifier stage 30 comprises the input amplifier circuit 100 and the buffer circuit 200 is to design the transconductance of the input amplifier circuit 100 independently versus any slew rate concern to ensure better noise and offset performances. Moreover, thanks to the large gain from the input amplifier circuit 100, the buffer circuit 200 undergoes the desired slew rate limitations more easily, even in the presence of small spikes of the regulated output voltage Vreg at the output node O.

Due to the slew rate limitation of the control voltage Vc, the embodiment of the LDO shown in FIG. 1 allows to keep the derivative of the output current Iout small in the case of a large output current Iout. However, in the case of a low output current Iout, the slew rate limitation of the control voltage Vc causes that the response to output/load current variations becomes too slow and, unless very large load caps are used, it is the regulated output voltage Vreg that is affected by large voltage spikes instead of the supply voltage.

Figure 2:
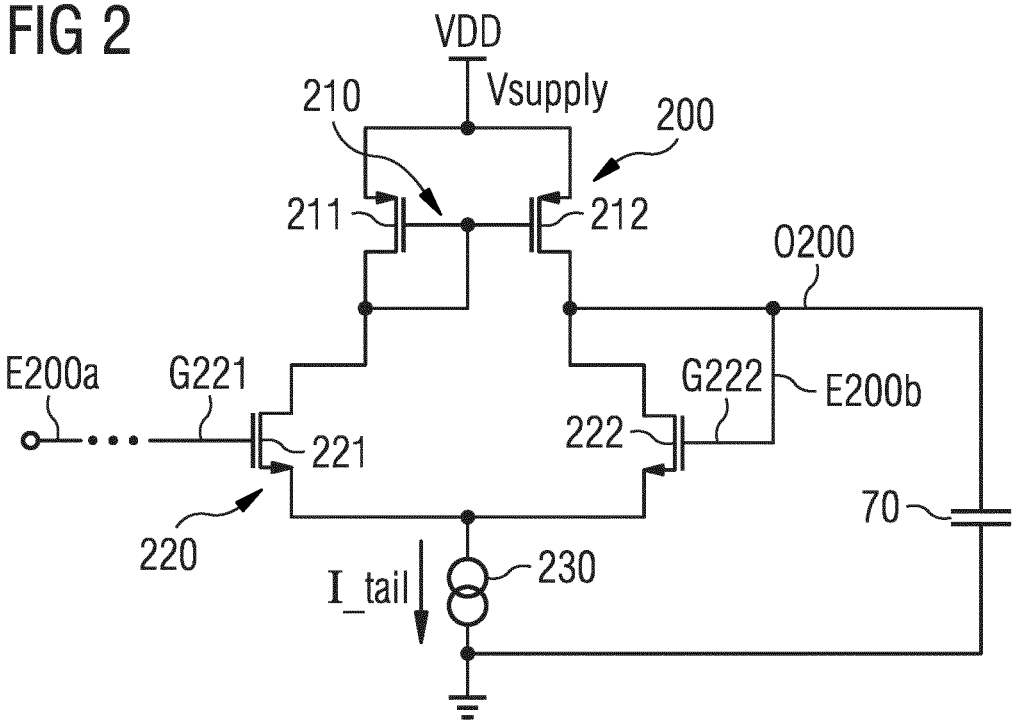
FIG. 2 shows an embodiment of the slew rate limited buffer circuit to provide the control voltage to control the output driver.

FIG. 2 shows a possible embodiment of the buffer circuit 200. The buffer circuit 200 comprises a current mirror 210, a differential input amplifier stage 220 and a bias current source 230 to provide a bias current I_tail for the differential input amplifier stage 220. The current mirror circuit 210, the differential input amplifier stage 220 and the bias current source 230 are connected in series between the supply line Vsupply to provide the supply potential VDD and a reference potential VSS. The differential input amplifier stage 220 is connected to the input connection E200*a* of the buffer circuit 200 that receives the output signal OS of the input amplifier circuit 100 and is further connected to the input connection E200*b* of the buffer circuit 200 that is fed back to the output side O200 of the buffer circuit 200.

According to the embodiment shown in FIG. 2, the differential input amplifier stage 220 comprises a transistor 221 having a control connection G221 being connected to the input connection E200*a* of the buffer circuit 200. The differential input amplifier stage 220 comprises a transistor 222 having a control connection G222 that is connected to the input connection E200*b* of the buffer circuit 200. The respective source connections of the transistors 221 and 222 are connected to the bias current source 230. The current mirror circuit 210 comprises the transistors 211 and 212 that may be configured as P-MOS mirrors, as shown in FIG. 2. According to an alternative embodiment, the transistors 221 and 222 may be configured as N-MOS transistors. The capacitor 70 is arranged between the output connection O200 of the buffer circuit 200 and the bias current source 230 or the reference potential VSS.

In order to prevent large voltage spikes of the output voltage Vreg in the case of a small output/load current Iout, the input amplifier stage 30 shown in FIG. 1 is configured to provide the control voltage Vc with a different slew rate in dependence on an increase or a decrease of the output current Iout. The idea is to unbalance the slew rate of the control voltage Vc, for example the slew rate of the gate-source voltage Vc by providing different slopes/ramps of the control voltage Vc at the gate connection G20 of the power transistor 20. In particular, the input amplifier stage 30 generates the control voltage Vc with a larger slew rate in the case of an increase of the output current Iout in comparison to a decrease of the output current Iout.

According to the embodiment of the LDO shown in FIG. 1, the input amplifier stage 30 is configured so that the control connection G20 of the output driver 20, for example a gate connection of the power transistor, is charged/discharged by means of two control currents Ic having different values. The control current Ic that makes a decrease in the control voltage/gate-source voltage Vc of the transistor 20, is chosen to be smaller than the one that increases it to face the larger sensitivity of the transistor 20 versus gate voltage variations at high current. This reduces the large spread of the output current derivative versus the current value. Both charge and discharge currents Ic might come from the buffer circuit 200 or directly from the input amplifier circuit 100 of the LDO. The capacitor 70 may be optionally added at the control connection G20 of the output driver 20 to emphasize the rise/fall time that drives it.

Assuming the output driver 20 being configured as an N-MOS transistor, as shown in FIG. 1, the input amplifier stage 30, for example the buffer circuit 200, is configured such that a larger value is chosen for the pull-up control current Ic versus the pull-down one. If the N-MOS gate G20 is pulled up in a transient, this means that the load current/output current Iout is small and the spikes at the supply line are quite tolerable. Conversely, attention has to be paid when the gate connection G20 is pulled down because this corresponds to a larger power device transconductance.

In order to realize that the increase of the output/load current Iout takes place with a larger slew rate of the control voltage Vc in comparison to the load/output current decrease, the current mirror circuit 210 of the buffer circuit 200 is configured having a gain K superior to 1. This is because a lower load/output current Iout is less critical than a high one in terms of supply-induced disturbance and faster variations of the control voltage Vc are better tolerated. Providing the current mirror circuit 210 with a gain K superior to 1 makes the pull-up current equal to K*I_tail and keeps the pull-down contribute at I_tail.

The consequent offset from the buffer circuit 200 is negligible, being divided by the gain of the input amplifier circuit 100, if referred to the LDO input. If the input amplifier stage 30 only comprises the input amplifier circuit 100 and the buffer circuit 200 is skipped, the offset is eliminated by mismatching the input differential pair by the same K ratio. According to the embodiment of the LDO 1 shown in FIGS. 1 and 2, the mean to alter the ratio K between pull-up and pull-down control currents Ic is preferably a mismatched active load current mirror, i.e. a current mirror circuit 210 having gain different from unity, which is driven by a differential pair.

The embodiment of the LDO as shown in FIGS. 1 and 2 enables to boost the slew rate of the control voltage Vc for rising edges of the output current Iout, but there is no information available for how small the output current Iout is. This information might be useful to further boost the charge/discharge control current Ic, if the output current Iout, i.e. the transconductance gm of the output driver 20, is near the lowest boundary.

Figure 3:
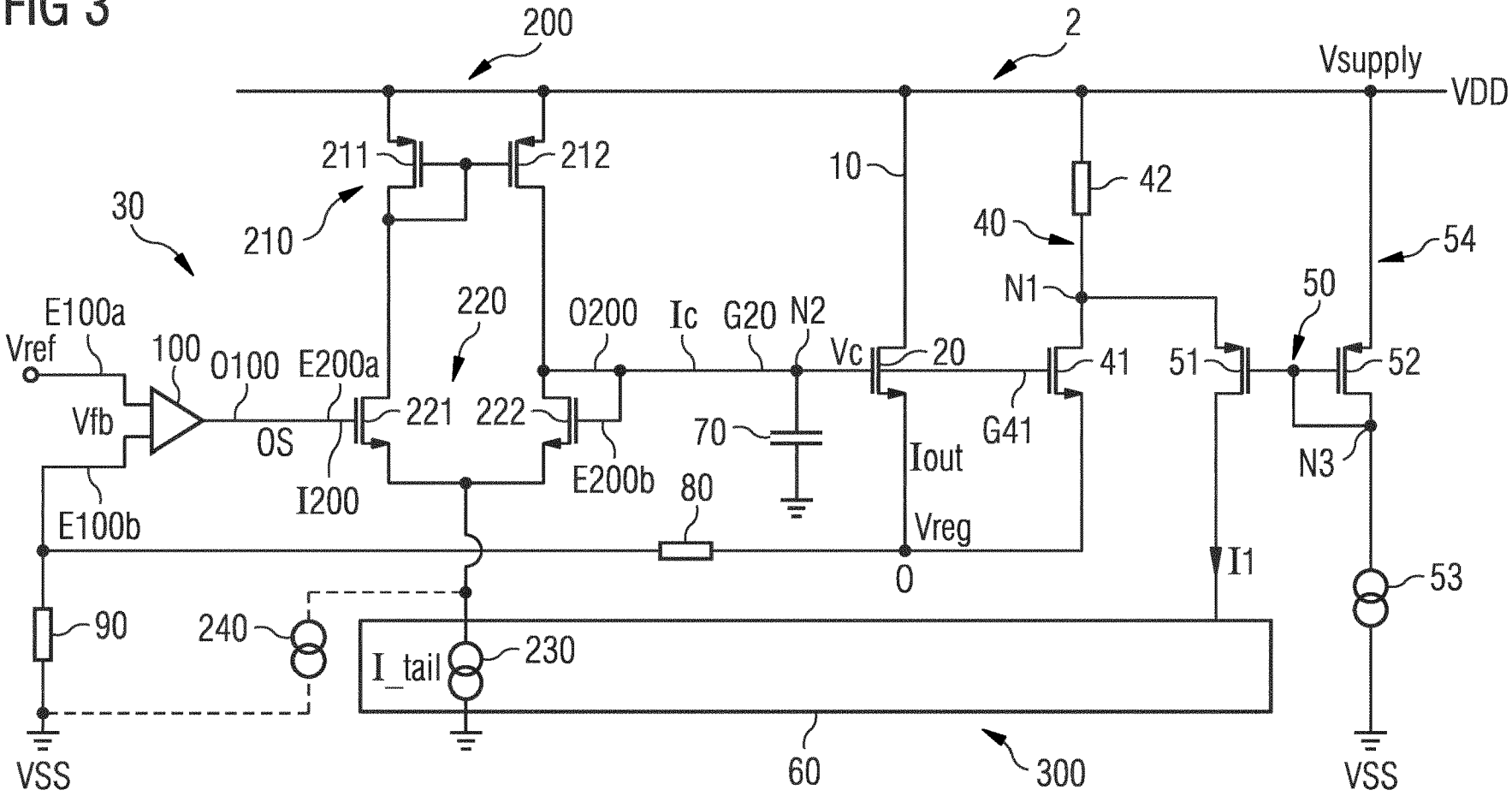
FIG. 3 shows a second embodiment of an LDO to regulate a slew rate of a control voltage applied to a control connection of an output driver of the LDO.

FIG. 3 shows a second embodiment of an LDO 2, wherein both charge and discharge control currents Ic are obtained as a function of the output current Iout. The control connection G20 of the output driver 20, for example the gate connection of the transistor 20, is charged faster at a low output current Iout, and charged slower at a large output current Iout. The input amplifier stage 30 may generate the control voltage Vc, such that the value of the control voltage increases faster when the output current is low, and the control voltage increases more slowly, when the value of the output current Iout is high.

That means that in terms of supply-induced disturbances caused by a variation of the control voltage Vc at the control connection G20, the associated supply control derivative remains small enough and is still acceptable when the output current Iout is large. On the other hand, when the output current Iout is low, the LDO shows a fast response caused by the increased slew rate of the control voltage Vc so that spikes of the regulated output voltage are reduced.

The LDO 2 comprises the output current branch 10 arranged between the supply line Vsupply to provide the supply potential VDD and the output node O to provide the regulated output voltage Vreg. The output current branch 10 comprises the output driver 20 to provide the output current Iout at the output node O. The LDO further comprises the input amplifier stage 30 to provide the control voltage Vc at the control connection G20 of the output driver 20 to control the conductivity of the output driver 20. The input amplifier stage 30 comprises the amplifier circuit 100 and the buffer circuit 200. The output side O100 of the input amplifier circuit 100 is connected to the input side I200 of the buffer circuit 200. The output side O200 of the buffer circuit 200 is connected to the control connection G20 of the output driver 20. The buffer circuit 200 comprises the current mirror circuit 210, the differential input amplifier stage 220 and the bias current source 230. The buffer circuit 200 generates the control voltage Vc at the output side O200. The capacitor 70 is connected to the output side O200 of the buffer circuit 200/the control connection G20 of the output driver 20 and a reference potential VSS.

The input amplifier circuit 100 has an input connection E100*a* to apply the reference signal Vref and an input connection E100*b* to apply the feedback signal Vfb being derived from the regulated output voltage Vreg. The buffer circuit 200 receives the output signal OS of the input amplifier circuit 100 at an input connection E200*a*. An input connection E200*b* of the buffer circuit 200 is connected to the output side O200 of the buffer circuit 200. The feedback signal Vfb applied to the input connection E100*b* of the input amplifier circuit 100 is derived from the regulated output voltage Vreg by the voltage divider comprising the resistors 80 and 90.

The LDO 2 comprises a control circuit 300 to control the bias current source 230 of the buffer circuit 200 so that the buffer circuit 200 provides the control voltage Vc at the output side O200 with a larger slew rate, when the output current Iout increases from a first level to a second level. Furthermore, the control circuit 300 controls the bias current source 230 of the buffer circuit 200 so that the buffer circuit 200 provides the control voltage Vc at the output side O200 of the buffer circuit 200 with a smaller slew rate, when the output current Iout increases from the second level to a third level. The first level of the output current is smaller than the second level of the output current, and the second level is smaller than the third level. In order to realize the described operation of the LDO, the LDO 2 comprises a current path 40 and a current mirror stage 50.

The current path 40 is connected between the supply line Vsupply to provide the supply potential VDD and the reference potential VSS. The current path 40 comprises a current driver 41 to provide a replica of the output current Iout of the output current branch 10 in the current path 40. The current driver 41 may be configured as a transistor, for example an N-MOS transistor. The current path 40 further comprises a resistor 42 being connected to the supply line Vsupply and being connected in series to the current driver 41. The current driver 41 is connected to the output node O of the LDO. In particular, the source connection of the current driver 41 is connected to the output node O of the LDO and the control connection/gate connection G41 of the current driver/transistor 41 is connected to the output side O200 of the buffer circuit 200. The current driver 41 is connected with its drain connection to the resistor 42.

The current mirror stage 50 is coupled to the current path 40 and the control circuit 300. The control circuit 300 may be configured as a current mirror stage 60. The current mirror stage 50 is coupled to the current mirror stage 60. The current mirror stage 50 is configured to provide a control current I1 in the current mirror stage 50 to control the bias current I_tail of the bias current source 230 of the buffer circuit 200. The current mirror stage 50 comprises a transistor 51 being arranged between the current mirror stage 60 and a node N1 of the current path 40 located between the current driver 41 and the resistor 42. The current mirror stage 50 further comprises a transistor 52 and a current source 53 being arranged in a current path 54 between the supply line Vsupply and the reference potential VSS. The control connections of the transistors 51 and 52 are directly connected to each other and are additionally connected to a node N3 of the current path 54 between the transistor 52 and the current source 53.

According to the embodiment of the LDO 2, the charge and discharge current Ic are obtained from the shared current root/bias current source 230 that generates the bias current I_tail. The bias current source 230 tracks the output current Iout. The bias current source 230 generates the bias current I_tail with a higher value when the output driver 20 is operated in a low conductive state or nearly in the off-state, and it is minimum when the output driver 20 is crossed by the largest foreseen value of the output current Iout.

In this way, both positive and negative supply current derivatives are reduced when the output driver 20 is biased at the control connection G20 by a large charge/discharge control current Ic, a condition which corresponds to the most critical stress of the supply line Vsupply, while they are kept sufficiently large when the charge/discharge control current Ic is small. This corresponds to the most critical condition for the LDO response speed, while it is not significantly affecting the supply line with disturbances.

The shared current root/the bias current I_tail is obtained by mirroring the output current Iout into a replica in such a way that a larger replica makes a smaller value for the bias current I_tail. The current driver 41 and the resistor 42 of the current path 40 are used together with the current mirror stage 50 and the control circuit 300 to sense the output current Iout and to change the bias current I_tail of the bias current source 230 of the buffer circuit 200, or change a bias current directly in the input amplifier circuit 100, if the buffer circuit 200 is omitted.

According to the embodiment of the LDO 2 shown in FIG. 3, the current driver/transistor 41, matched to the output driver 20, brings its current across the resistor 42. The current driver 41 mirrors a replica of the output current Iout into the resistor 42. As soon as the output current Iout becomes larger, the consequent voltage drop across the resistor 42 alters the gate-source voltage of the transistor 51 in such a way that the current mirrored from the matched transistor 42 is different and decreases for large currents in the current driver 41. That means that the voltage drop across the resistor 42 decreases the current I1 mirrored by the transistor 51 from the transistor 52 and decreases the bias current I_tail of the slew rate limited buffer circuit 200.

In this way, unlike the implementation 1 of the LDO shown in FIGS. 1 and 2, the slew rate control current Ic depends not only on the sign of the current variation of the output current Iout in the current output branch 10 but also on the value of the output current Iout, ensuring larger response promptness when the output current Iout is small, that is to say when the spikes at the supply voltage are not a severe issue and the spikes at the regulated output voltage might be very critical. The solution shown in FIG. 3 fully copes, thanks to the reduced voltage required at the resistor terminals of the resistor 42, with the aggressive swing demands for Vsupply/Vreg, typically of an LDO. In particular, the embodiment of the LDO 2 shown in FIG. 3 allows a faster drive at a small load current/output current Iout. In this way worst case supply disturbances are left unaltered while the regulated output voltage spikes, critical at light values of the output current Iout, are significantly reduced.

Regarding the embodiment 2 of the LDO shown in FIG. 3, of course, possible alternatives are possible, like the one to add a constant current value, independent from the voltage drop across the resistor 42, in parallel to the current I_tail. FIG. 3 shows an additional constant current source 240 to provide the additional constant current value in a dashed line.

Figure 4:
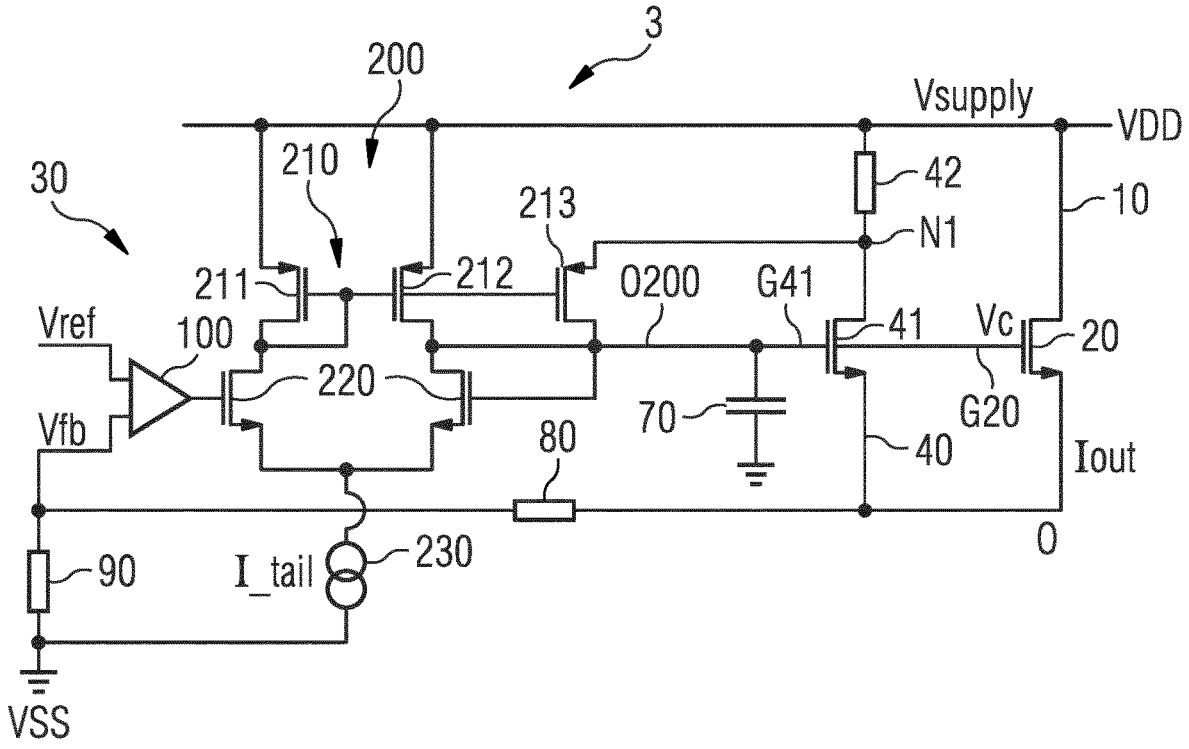
FIG. 4 shows a third embodiment of an LDO to regulate a slew rate of a control voltage applied to a control connection of an output driver of the LDO.

FIG. 4 shows a third embodiment of the LDO 3 that is an alternative to the embodiment 2 of the LDO shown in FIG. 3 or may be used in synergy to the solution of the LDO 2.

The LDO 3 comprises the output current branch 10 with the output driver 20 to provide the output current Iout at the output node O. The LDO 3 further comprises the input amplifier stage 30 comprising the input amplifier circuit 100 and the buffer circuit 200. The buffer circuit 200 comprises the current mirror circuit 210, the differential input amplifier stage 220 and the bias current source 230 to provide the bias current I_tail.

The embodiment of the LDO 3 shown in FIG. 4 further comprises the current path 40 comprising the current driver 41 and the resistor 42 as known from the embodiment of the LDO 2 shown in FIG. 3. The capacitor 70 is connected to the output side O200 of the buffer circuit 200. The control connections G20 of the output driver 20 as well as the control connection G41 of the current driver 41 are connected to the output side O200 of the buffer circuit 200.

When compared to the embodiment of the LDO 2 shown in FIG. 3, the current mirror circuit 210 of the buffer circuit 200 additionally comprises a transistor 213 being arranged between the output side O200 of the buffer circuit 200 and the node N1 of the current path 40 between the current driver 41 and the resistor 42 of the current path 40. Due to the configuration of the current mirror circuit 210, the buffer circuit 200 of the LDO 3 is configured such that the ratio of the current mirror circuit 210 is dependent on the output current Iout. That means that the buffer circuit 200 has a variable gain of its current mirror 210 depending on the level of the output current Iout.

The replica of the output current Iout is used to vary the current mirror ratio K of the current mirror circuit 210 to further reduce the rising edge/slew rate of the control voltage Vc of the output driver 20 when the output current Iout is getting large. If the voltage drop across the resistor 42 is negligible, the current mirror gets bigger because of the parallel connection of the transistors 212 and 213. On the contrary, if a large replica current flows across the resistor 42, the voltage drop across the resistor 42 puts off the transistor 213. The transistor 213 tends to mirror less current as soon as the transistor 41 drives more current That means that there is no large rise of the control voltage/gate voltage of the output driver 20, if the output current Iout is large.

The voltage drop across the resistor 42 can optionally be used to reduce the mirror gain for charging the control connection G20 of the output driver 20 in the case of a large output current Iout. Due to the minimum number of nodes/devices involved, the embodiment of the LDO 3 shown in FIG. 4 ensures the promptest response to vary the slew rate of the control voltage Vc.

Despite the solutions shown in FIGS. 1 to 4 are explicitly illustrated in the case of an N-MOS implementation, the same guidelines and considerations hold for a P-MOS solution, where, of course, pullup gate current is made smaller, not higher, than pulldown. Associated implementations are straightforward for those persons expert in the art.

LIST OF REFERENCE SIGNS

1, 2, 3 embodiments of LDO
10 output current branch
20 output driver
30 input amplifier stage
40 current path
41 current driver
42 resistor
50 current mirror stage
60 current mirror stage
70 capacitor
80, 90 resistors
100 input amplifier circuit
200 buffer circuit
210 current mirror circuit
220 differential input amplifier stage
230 bias current source
300 control circuit

The invention claimed is:

1. A low-dropout regulator, comprising:

an output node to provide a regulated output voltage;

an output current branch being arranged between a supply line to provide a supply potential and the output node, the output current branch comprising an output driver to provide an output current at the output node;

the output driver having a control connection to apply a control voltage, the output driver being configured to be operated with a different conductivity in dependence on the control voltage;

an input amplifier stage to provide the control voltage to the control connection of the output driver, wherein the input amplifier stage is configured to provide the control voltage with a different slew rate in dependence on an increase or decrease of the output current, wherein the input amplifier stage comprises an input amplifier circuit having an output side and a buffer circuit having an input side and an output side to provide the control voltage, wherein the output side of the input amplifier circuit is connected to the input side of the buffer circuit, wherein the output side of the buffer circuit is coupled to the control connection of the output driver, wherein the input amplifier circuit has a first input connection to apply a reference signal and a second input connection to apply a feedback signal being derived from the regulated output voltage, wherein the input amplifier circuit generates an output signal at the output side of the input amplifier circuit, wherein the buffer circuit has a first input connection to receive the output signal of the input amplifier circuit and a second input connection being coupled to the output side of the buffer circuit, wherein the buffer circuit comprises a current mirror circuit, a differential input amplifier stage and a bias current source to provide a bias current for the differential input amplifier stage, wherein the differential input amplifier stage is connected to the first input connection and the second input connection of the buffer circuit, a control circuit to control the bias current source of the buffer circuit so that the buffer circuit provides the control voltage at the output side of the buffer circuit with a first slew rate, when the output current increases from a first level to a second level, and with a second slew rate, when the output current increases from the second level to a third level, wherein the first level of the output current is smaller than the second level of the output current and the second level of the output current is smaller than the third level of the output current and the first slew rate is larger than the second slew rate;

a current path being connected between the supply line to provide the supply potential and a reference potential, wherein the current path comprises a current driver to provide a replica of the output current of the output current branch in the current path, wherein the current path comprises a resistor being connected to the supply line and in series to the current driver of the current path, wherein the current driver is connected to the output node of the low-dropout regulator, and a first current mirror stage being connected between the supply line and the reference potential, wherein the control circuit of the buffer circuit is configured as a second current mirror stage, wherein the first current mirror stage is coupled to the second current mirror stage, and wherein the first current mirror stage is configured to provide a control current in the second current mirror stage to control the bias current of the bias current source of the buffer circuit.

2. The low-dropout regulator of claim 1, wherein the input amplifier stage generates the control voltage with a larger slew rate in the case of an increase of the output current in comparison to a decrease of the output current.

3. The low-dropout regulator of claim 1, wherein the current mirror circuit of the buffer circuit has a gain superior to one.

4. The low-dropout regulator of claim 1, wherein the first current mirror stage comprises a transistor being arranged between the second current mirror stage and a node of the current path located between the current driver and the resistor of the current path.

5. The low-dropout regulator of claim 4, wherein the current mirror circuit of the buffer circuit comprises a transistor being arranged between the output side of the buffer circuit and the node of the current path between the current driver and resistor of the current path.

6. The low-dropout regulator of claim 1, wherein the buffer circuit is configured such that the ratio of the current mirror circuit is dependent on the output current.

7. The low-dropout regulator of claim 1, comprising:

a capacitor being arranged between the reference potential and the control connection of the output driver.

* * * * *